US008973939B2

(12) United States Patent
Melgarejo et al.

(10) Patent No.: US 8,973,939 B2
(45) Date of Patent: Mar. 10, 2015

(54) ADJUSTABLE SEATING FRAME AND FOOTREST ASSEMBLIES

(71) Applicant: Freedom Designs, Inc., Simi Valley, CA (US)

(72) Inventors: Mauricio Melgarejo, Simi Valley, CA (US); Michael H. Nordquist, Longmont, CO (US); Alejandro Melgarejo, Simi Valley, CA (US)

(73) Assignee: Freedom Designs, Inc., Simi Valley, CA (US)

( * ) Notice: Subject to any disclaimer, the term of this patent is extended or adjusted under 35 U.S.C. 154(b) by 16 days.

(21) Appl. No.: 13/768,261

(22) Filed: Feb. 15, 2013

(65) Prior Publication Data

US 2013/0214509 A1 Aug. 22, 2013

Related U.S. Application Data

(60) Provisional application No. 61/599,555, filed on Feb. 16, 2012.

(51) Int. Cl.

| | |
|---|---|
| ***A47C 16/00*** | (2006.01) |
| ***A61G 5/10*** | (2006.01) |
| ***A61G 5/12*** | (2006.01) |

(52) U.S. Cl.

CPC ..... *A61G 5/1056* (2013.01); *A61G 5/12* (2013.01); *A61G 2005/128* (2013.01)

USPC ..... 280/304.1; 280/291; 297/423.26; 297/423.35; 297/423.37

(58) Field of Classification Search

USPC ..... 280/304.1, 291; 297/423.26, 423.35, 297/423.37

See application file for complete search history.

(56) References Cited

U.S. PATENT DOCUMENTS

| | | | | |
|---|---|---|---|---|
| 2,868,275 | A | | 1/1959 | Mize |
| 3,230,010 | A | | 1/1966 | Mommsen |
| 3,453,027 | A | | 7/1969 | Pivacek |
| 3,482,873 | A | | 12/1969 | Pivacek |
| 3,854,774 | A | | 12/1974 | Limpach |
| 4,174,852 | A | * | 11/1979 | Panzica et al. ..... 280/291 |
| 4,176,879 | A | | 12/1979 | Rodaway |
| 4,722,572 | A | | 2/1988 | Sata |
| 4,729,573 | A | | 3/1988 | Davis |
| 4,770,467 | A | * | 9/1988 | Zinn ..... 297/423.37 |
| 4,790,553 | A | | 12/1988 | Okamoto |
| 4,840,390 | A | * | 6/1989 | Lockard et al. ..... 280/250.1 |
| 4,981,305 | A | * | 1/1991 | Lockard et al. ..... 280/250.1 |
| 5,076,602 | A | | 12/1991 | Robertson et al. |
| 5,186,480 | A | | 2/1993 | Morgan et al. |
| 5,364,165 | A | | 11/1994 | Okamoto |

(Continued)

*Primary Examiner* — Kevin Hurley
*Assistant Examiner* — Michael Stabley
(74) *Attorney, Agent, or Firm* — Calfee, Halter & Griswold LLP

(57) ABSTRACT

An adjustable seating frame assembly includes a side frame member, first and second joint members, a footrest hanger, a pivot fastener and a lock fastener. The first joint member is affixed to the side frame member and includes a first pivot aperture and at least one first lock aperture. The second joint member is affixed to the footrest hanger and includes a second pivot aperture and at least one second lock aperture. The pivot fastener is secured through the first and second pivot apertures to pivotally attach the second joint member to the first joint member. The lock fastener is secured through a selected one of the at least one first lock aperture and a selected one of the at least one second lock aperture to secure the second joint member in a selected one of a plurality of angular positions with respect to the first joint member.

21 Claims, 7 Drawing Sheets

(56) References Cited

U.S. PATENT DOCUMENTS

| | | | | |
|---|---|---|---|---|
| 5,401,045 | A * | 3/1995 | Foerster et al. | 280/250.1 |
| 5,522,644 | A | 6/1996 | Peek | |
| 6,155,586 | A | 12/2000 | Melgarejo et al. | |
| 6,182,982 | B1 * | 2/2001 | Fleigle | 280/43 |
| 6,217,050 | B1 | 4/2001 | Dickie et al. | |
| 6,234,576 | B1 * | 5/2001 | Fleigle | 297/423.37 |
| 6,273,443 | B1 * | 8/2001 | Fleigle | 280/304.1 |
| 7,331,632 | B2 * | 2/2008 | Wendt | 297/423.19 |
| 7,425,010 | B2 * | 9/2008 | Harris | 280/304.1 |
| 2004/0075327 | A1 * | 4/2004 | Adams | 297/423.4 |

* cited by examiner

ADJUSTABLE SEATING FRAME AND FOOTREST ASSEMBLIES

CROSS-REFERENCE TO RELATED APPLICATION

This application claims priority to and the benefit of U.S. Provisional patent application Ser. No. 61/599,555, entitled "ADJUSTABLE SEATING FRAME AND FOOTREST ASSEMBLIES" and filed Feb. 16, 2012, the entire disclosure of which is incorporated herein by reference.

BACKGROUND

Conventional wheelchairs are provided with footrest assemblies including footrest hangers mounted to a seating frame of the wheelchair, and footrest plates secured to the footrest hangers for supporting the wheelchair occupant's feet in a raised, off-the-floor position.

SUMMARY

The present application discloses exemplary embodiments of adjustable seating frames and footrest assemblies for use with a variety of apparatuses, including, for example, a wheelchair. In one exemplary embodiment, an adjustable seating frame assembly is configured to position a footrest assembly (e.g., a footrest hanger and footrest plate) in a selected angled forward extending position. In another exemplary embodiment, an adjustable footrest assembly is configured to position a footrest plate in at least one of an angled planar position with respect to a footrest hanger, and a planar position within a plane defined by the footrest plate.

Accordingly, in an exemplary embodiment, an adjustable seating frame assembly for a wheelchair includes a side frame member, a first joint member affixed to the side frame member, a footrest hanger, and a second joint member affixed to the footrest hanger. The first and second joint members each include a pivot aperture and at least one lock aperture. A pivot fastener is secured through the pivot apertures of the first and second joint members to pivotally attach the second joint member to the first joint member. A lock fastener is secured through selected ones of the lock apertures of the first and second joint members to secure the second joint member in a selected angular position with respect to the first joint member. The second joint member is securable to the first joint member in a plurality of angular positions with respect to the first joint member.

In another exemplary embodiment, a method is contemplated for adjusting an angle of a footrest hanger on a wheelchair having a side frame member secured to a first joint member and a footrest hanger secured to a second joint member. The footrest hanger and the second joint member are pivoted about a pivot fastener secured through aligned pivot apertures in the first and second joint members to a selected angular position of the footrest hanger. A lock fastener is installed through aligned lock apertures in the first and second joint members to secure the footrest hanger in the selected angular position.

In still another exemplary embodiment, an adjustable footrest assembly for a wheelchair includes a footrest hanger having a vertically extending section, a footrest plate having a substantially planar foot supporting surface, a mounting bracket secured to the vertically extending section of the footrest hanger, and a ball joint including a ball portion received in a concave spherical recess in the mounting bracket and a stem portion secured to the footrest plate. A clamping member is disposed between the footrest plate and the mounting bracket, and assembled with the mounting bracket to clamp the ball portion of the ball joint between the clamping member and the mounting bracket.

In yet another exemplary embodiment, a method is contemplated for positioning a footrest plate on a wheelchair including a side frame member secured to a first joint member, a footrest hanger secured to a second joint member, a mounting bracket secured to the footrest hanger, and a footrest plate secured to the mounting bracket. In the exemplary method, the footrest hanger and the second joint member are pivoted with respect to the first joint member, to a selected angular position of the footrest hanger. The footrest hanger and the second joint member are secured in the selected angular position. The footrest plate is positioned in a selected planar position, and the footrest plate is secured in the selected planar position.

BRIEF DESCRIPTION OF THE DRAWINGS

Further features and advantages will become apparent to those of ordinary skill in the art to which the invention pertains from a reading of the following description together with the accompanying drawings, in which.

DESCRIPTION

Figure 1A:
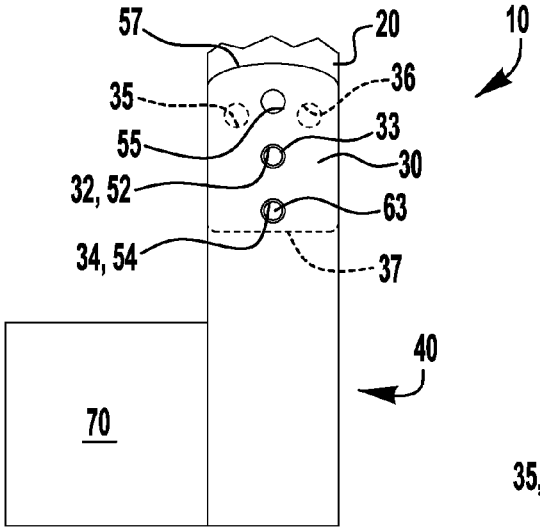
FIG. 1A is partial top schematic view of an adjustable footrest assembly shown in a first angular position, according to an exemplary embodiment.

This Description merely describes exemplary embodiments and is not intended to limit the scope of the claims in any way. Indeed, the invention as claimed is broader than and unlimited by the exemplary embodiments, and the terms used in the claims have their full ordinary meaning.

As described herein, when one or more components are described as being connected, joined, affixed, coupled, attached, or otherwise interconnected, such interconnection may be direct as between the components or may be indirect, such as through the use of one or more intermediary components. Also as described herein, reference to a "member,"

"component," or "portion" shall not be limited to a single structural member, component, or element but can include an assembly of components, members or elements.

Wheelchairs are generally provided with leg support frame and footrest assemblies that are oriented to support standard or neutral skeletal alignment of the lower extremities (e.g., pelvis, legs, ankles, and feet). When a wheelchair user possesses moderate to severe skeletal deformities of these lower extremities (for example, due to birth defects, accidents, ailments, or historic long term wheelchair use), the resulting deviation from this neutral alignment often requires specialized or adapted components to enable the leg support frame and footrest assemblies to accommodate the user. These specialized adaptations (e.g., a foot retaining box bolted to the footrest plate) add cost, size, and complexity to the wheelchair, and draw unwanted attention to the deformities of the user.

According to one aspect of the present application, an adjustable seating frame and footrest assembly for a wheelchair is configured to accommodate a range of lower extremity positioning requirements of a wheelchair user. In one such embodiment, a horizontally pivoting joint (i.e., pivoting about a vertical axis) between the side frame member and the footrest hanger allows for adjustable angular positioning of the entire footrest hanger, for example, to accommodate lower skeletal deformities of the user, such as abduction, adduction, pelvic rotation, leg length deformity, and/or windswept legs.

While many different configurations may be utilized to provide adjustable angular positioning of a footrest hanger (or some other seating frame component) with respect to a wheelchair side frame member, in an exemplary embodiment, a first joint member is secured to the side frame member and a second joint member is secured to the footrest hanger, with the second joint member being configured to be secured to the first joint member in a plurality of angular positions. In an exemplary embodiment, first and second pivotally connected joint members are each provided with one or more lock apertures positioned such that in a selected angular position of the second joint member, at least one of the one or more lock apertures of the first joint member aligns with at least one of the one or more lock apertures of the second joint member, to receive at least one lock fastener through the aligned lock apertures. In one embodiment, pivoting movement of the second joint member aligns a lock aperture in the first joint member with one of a plurality of lock apertures in the second joint member to provide for a plurality of angular positions of the second joint member. In another embodiment, pivoting movement of the second joint member aligns a lock aperture in the second joint member with one of a plurality of lock apertures in the first joint member to provide for a plurality of angular positions of the second joint member. In still another embodiment, each of the first and second joint members includes a plurality of lock apertures, with at least one of the plurality of first joint member lock apertures aligning with at least one of the plurality of second joint member lock apertures in any of the available angular positions of the second joint member.

Figure 1B:
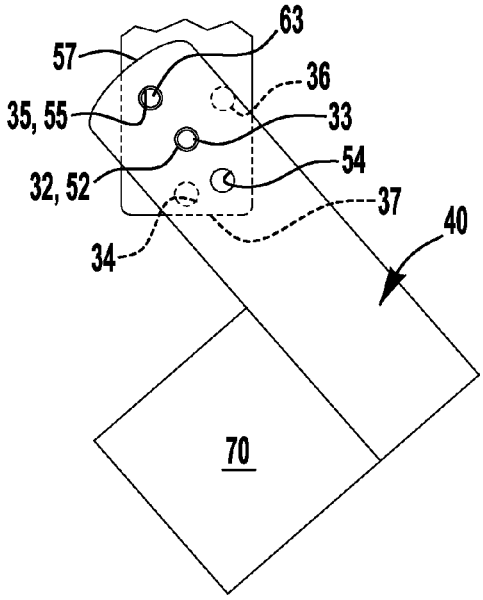
FIG. 1B is a partial top schematic view of the adjustable footrest assembly of FIG. 1A, shown in a second angular position.
Figure 1C:
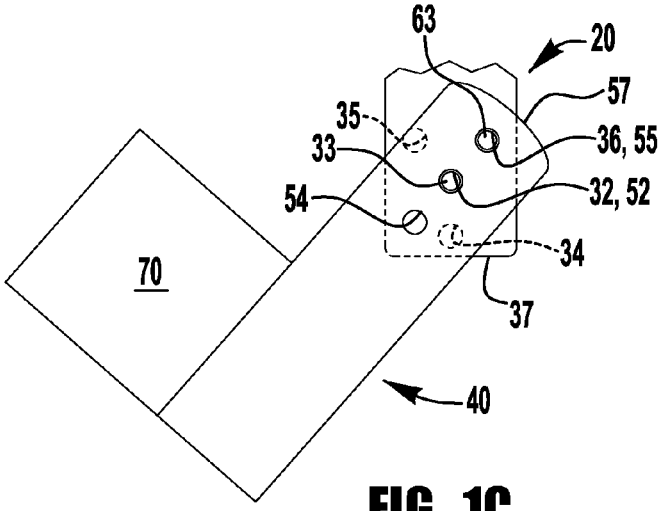
FIG. 1C is a partial top schematic view of the adjustable footrest assembly of FIG. 1A, shown in a third angular position.
Figure 2:
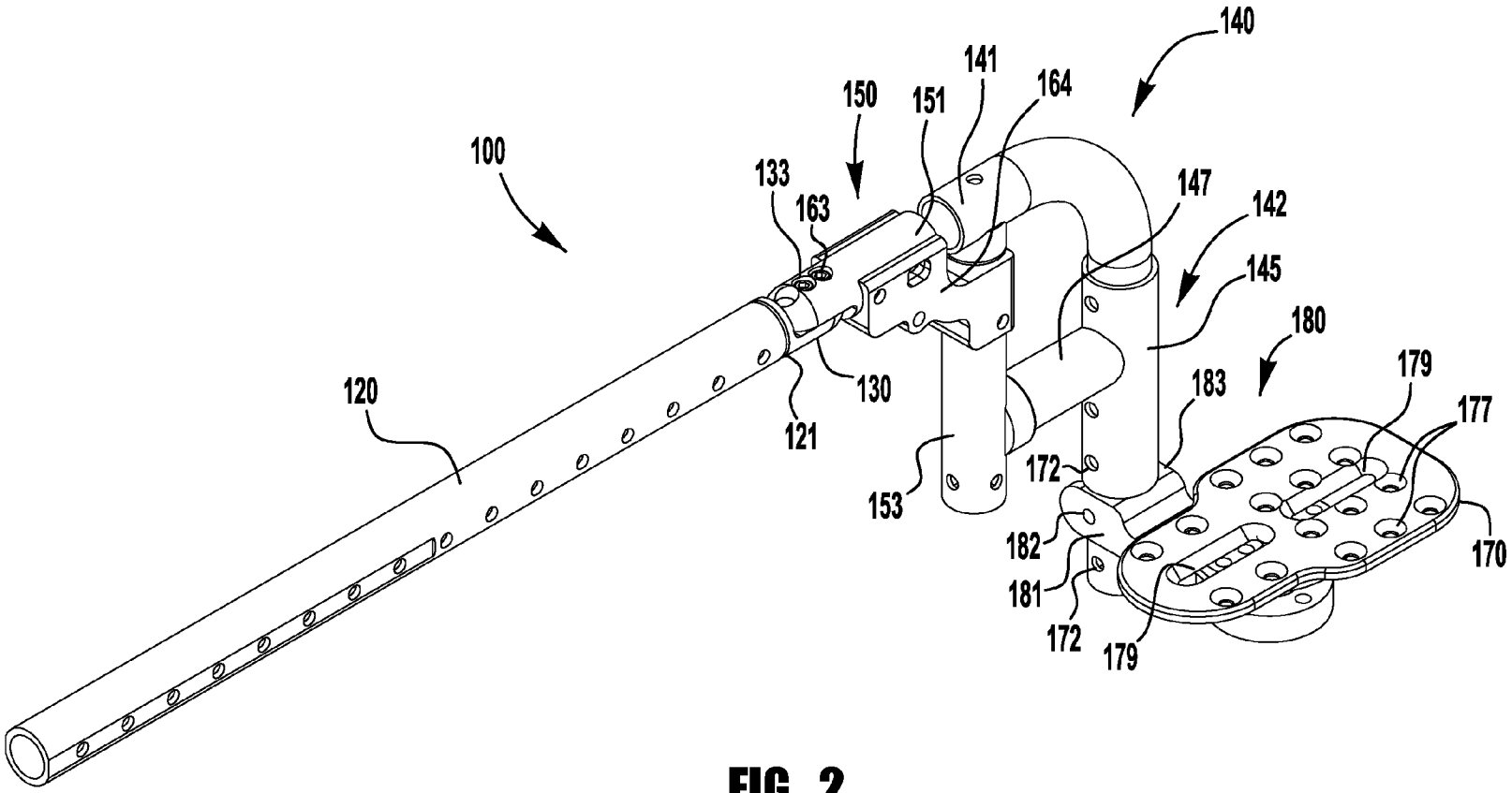
FIG. 2 illustrates an upper perspective view of an adjustable footrest assembly, according to an exemplary embodiment.

FIGS. 1A-1C schematically illustrate partial top schematic views of an exemplary adjustable seating frame assembly 10 (e.g., for a wheelchair) including a vertically extending footrest hanger 40 assembled with a horizontally extending side frame member 20. A first joint member 30 is secured to the side frame member 20 (e.g., integrally or as an assembly), and a second joint member 50 is secured to the footrest hanger 40 (e.g., integrally or as an assembly). A wheelchair may, but need not, include an identical or mirror image second footrest assembly (not shown) on an opposite side of the wheelchair.

The first and second joint members 30, 50 each include pivot apertures 32, 52 that align to receive a pivot fastener 33 (e.g., a bolt or pin) about which the second joint member is permitted to pivot to adjust an angular position of the second joint member 50 with respect to the first joint member 30, for example to adjust the orientation of a footrest 70, mounted to the footrest hanger 40, with respect to the side frame member 20. In a first angular position of the second joint member (FIG. 1A), a first lock aperture 34 of the first joint member 30 aligns with a first lock aperture 54 of the second joint member 50 to receive a lock fastener 63, which secures the second joint member 50 in the first angular position. In a second angular position of the second joint member 50 (FIG. 1B), a second lock aperture 35 of the first joint member 30 aligns with a second lock aperture 55 of the second joint member 50 to receive the lock fastener 63 (or any other suitable lock fastener), which secures the second joint member 50 in the second angular position. In a third angular position of the second joint member 50 (FIG. 1C), a third lock aperture 36 of the first joint member 30 aligns with the second lock aperture 55 of the second joint member 50 to receive the lock fastener 63 (or any other suitable lock fastener), which secures the second joint member 50 in the third angular position.

As shown, to accommodate multiple lock apertures on a relatively narrow joint member, the first joint member 30 may include at least one lock aperture 34 proximal to a terminal end 37 of the first joint member 30, and at least one lock aperture 35, 36 distal to the terminal end 37 of the first joint member 30 and opposite the pivot aperture 32. Similarly, the second joint member 50 may include at least one lock aperture 55 proximal to a terminal end 57 of the second joint member 50, and at least one lock aperture 54 distal to the terminal end 57 of the second joint member 50 and opposite the pivot aperture 52.

To adjust the angular position of the second joint member 50 with respect to the first joint member 30, the lock fastener 63 is removed from the aligned lock apertures (34, 54; 35, 55; or 36, 55), and the footrest hanger 40 and second joint member 50 are pivoted about the pivot fastener 33 to a desired angular position coinciding with alignment of lock apertures of the first and second joint members 30, 50. The lock fastener is installed through the newly aligned lock apertures (34, 54; 35, 55; or 36, 55) to secure the footrest hanger 40 and second joint member 50 in the selected angular position.

As described herein, the lock apertures may be provided as holes extending through the joints, as shown in FIGS. 1A-1C. Alternatively, other features, such as notches, blind bores, counterbores, slots, or portions of slots may be utilized as lock apertures receiving at least a portion of a lock fastener. As one example (not shown), a slot having enlarged holes or cutouts corresponding to desired angular positions and sized to interlock with an enlarged lock fastener head may allow for adjustment of the angular position of the second joint member without complete removal of the lock fastener.

The adjustable seating frame and footrest assembly arrangements described above may be used with a variety of different wheel chair side frame members and footrest hangers. For example, the side frame member may include a square, rectangular, circular, or other cross-sectioned tubular member attached to a first joint member. The footrest hanger may be permanently or releasably attached to the second joint member. In one embodiment, a footrest hanger of a swing-away configuration is mounted to the second joint member for pivotal movement about a vertical axis between a position in front of the chair and a position beside the chair. Examples of swing-away footrest hanger configurations are described in U.S. Pat. Nos. 3,854,774 and 4,790,553, the entire disclosures of which are incorporated herein by reference. In another embodiment, a footrest hanger having a spring-loaded releasing mechanism may be releasably attached to a second joint member for easy detachment of the footrest hanger and footrest (e.g., to facilitate stowing or transportation of the wheelchair. An example of a spring-loaded releasing mechanism for a footrest hanger is described in U.S. Pat. No. 6,155,586, the entire disclosure of which is incorporated herein by reference.

Figures 5, 6:
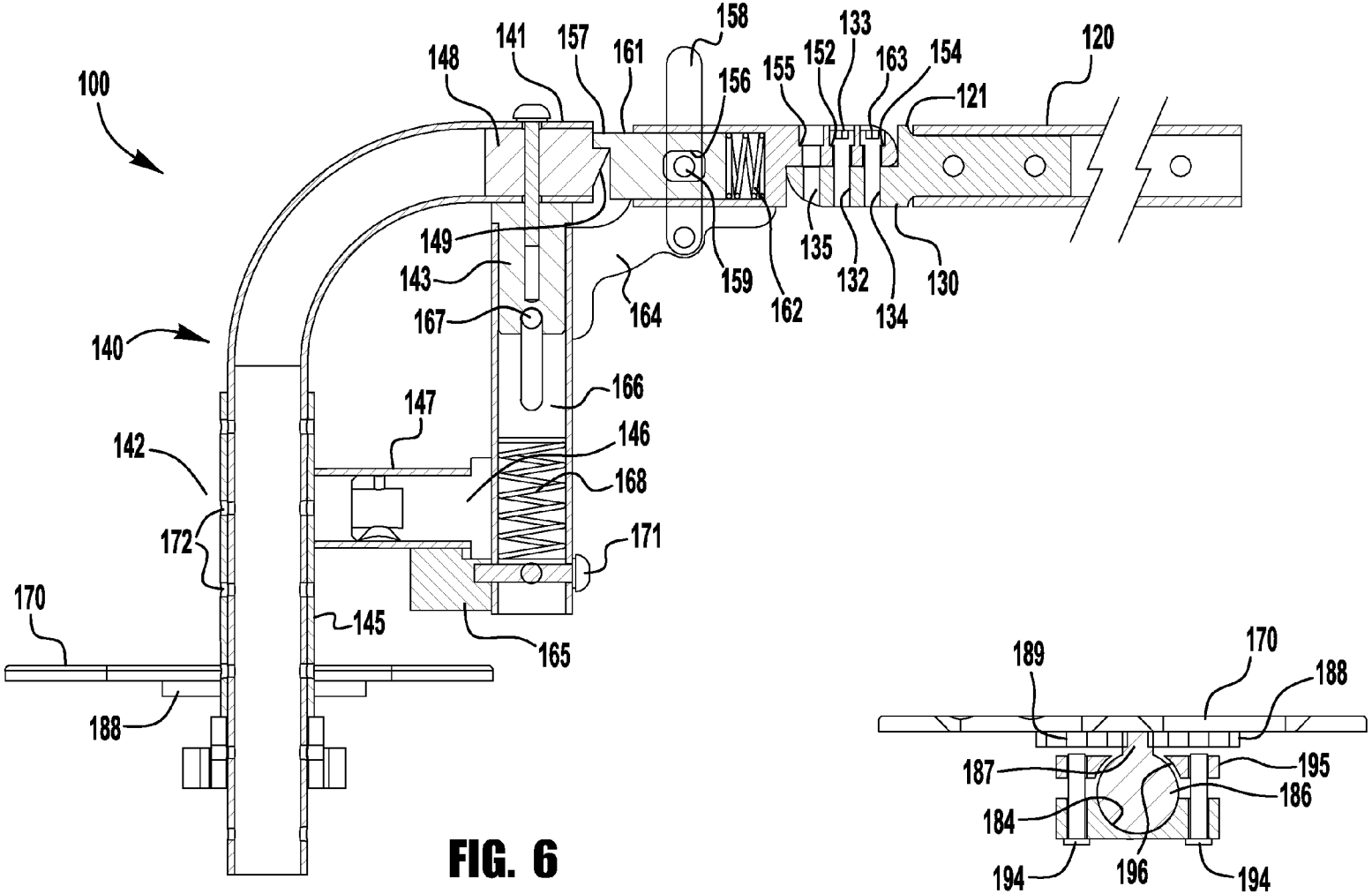
FIG. 5 illustrates a side cross-sectional view of the footrest assembly of FIG. 2.
FIG. 6 illustrates another side cross sectional view of the footrest assembly of FIG. 2.
Figure 7:
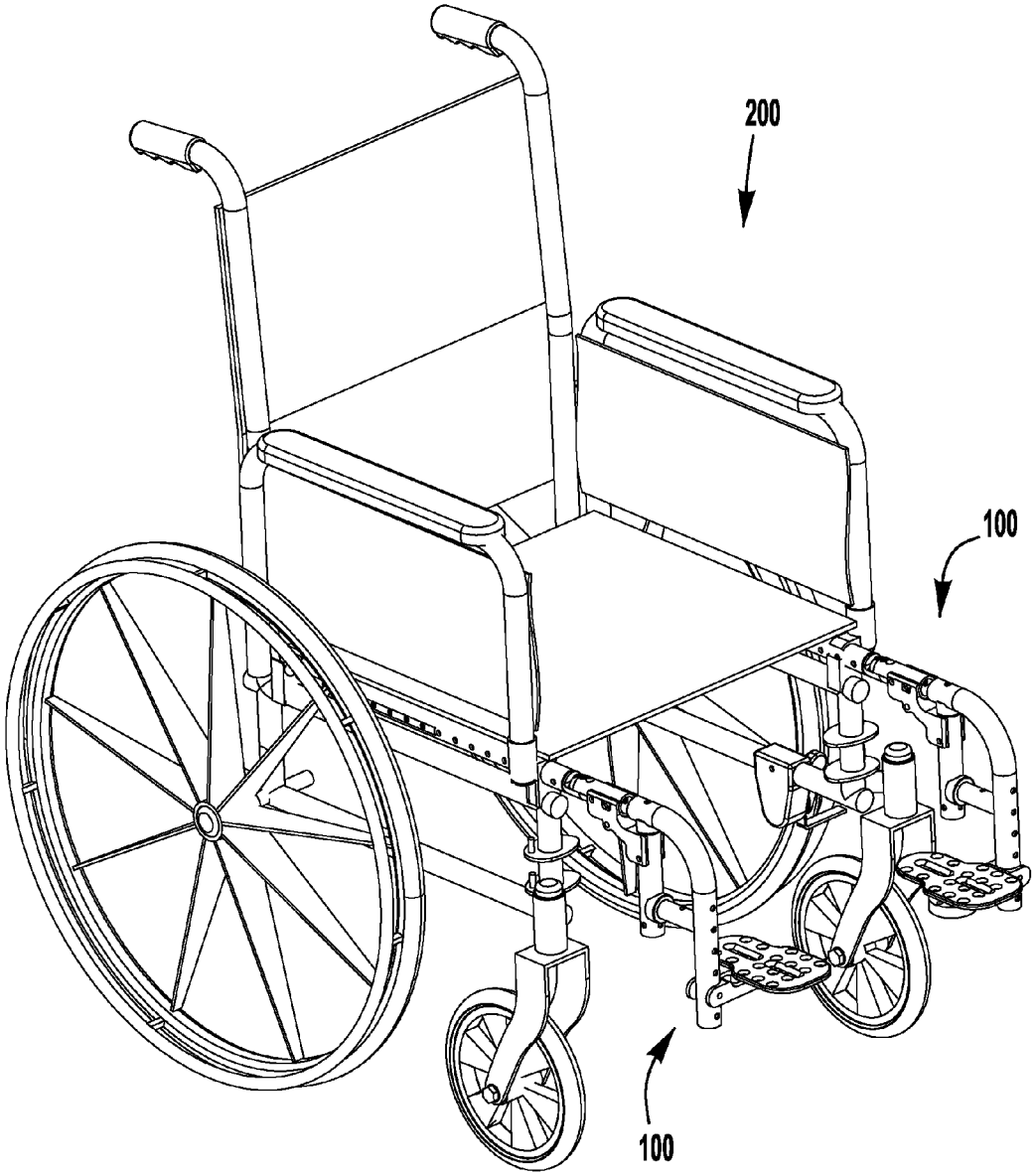
FIG. 7 illustrates a perspective view of a wheelchair assembly including the footrest assembly of FIG. 2.

FIGS. 2-6 illustrate various views of an exemplary adjustable seating frame and footrest assembly 100 including a vertically extending releasable footrest hanger 140 assembled with, and angularly adjustable with respect to, a horizontally extending tubular side frame member 120. A first joint member 130 is received in an open end 121 of the side frame member, and is secured to the side frame member 120 by a bolt assembled through aligned holes in the first joint member 130 and side frame member 120. A second joint member 150 is pivotally attached to the first joint member 130 and is configured to releasably attach to the footrest hanger 140. A wheelchair may, but need not, include an identical or mirror image second footrest assembly on an opposite side of the wheelchair. FIG. 7 illustrates an exemplary wheelchair 200 utilizing the exemplary adjustable seating frame and footrest assemblies 100 of FIGS. 2-6.

While any suitable detachable engagement between the second joint member and the footrest hanger may be utilized, in the illustrated embodiment, the second joint member 150 may be configured to engage the footrest hanger 140 at three separate locations, to provide additional support and rigidity for the footrest hanger. The exemplary second joint member 150 includes a horizontal tubular section 151 that retains a latch member 161 biased outward of the horizontal section by a spring 162 for interlocking engagement with a corresponding locking insert 148 of a footrest hanger 140 (see FIG. 6). The second joint member 150 further includes a vertical tubular section 153 secured to the horizontal tubular section 151 by a gusset 164, for receiving a downward extending fitting 143 of the footrest hanger 140. As shown in FIG. 6, the second joint member may also include a support block 165 fastened to the vertical tubular section 153 (e.g., by a fastener 171) for supporting a horizontal brace 147 that extends from the vertical portion 142 of the footrest hanger 140 and abuts the vertical tubular section 153. While the brace may be secured directly to the vertical portion, in the illustrated embodiment, the horizontal brace 147 is provided on a tee member 145 assembled with the vertical portion 142.

Referring to FIG. 6, to lock the footrest hanger 140 with the second joint member 150, the downward extending fitting 143 is inserted into the vertical tubular section 153 of the second joint member 150 and is pushed downward to compress a guide 166 within the vertical tubular section against a spring 168. An angled surface 149 of the locking insert 148 engages a corresponding angled surface 157 of the latch member 152 to force the latch member against the spring 162 and into the horizontal tubular section 151. When the insert angled surface 149 is pushed past the latch member angled surface 157, the latch member 152 snaps outward (under force of spring 162) to interlock with the insert 148. In this locked position, notches 144 in the fitting 143 receive a cross bolt 167 extending through the vertical tubular section 153, to impede rotation of the footrest hanger 140 about the fitting 143. A contoured bumper 146 at the end of the horizontal brace 147 abuts the vertical tubular section 153, and the support block 165 engages an underside of the brace 147 to further reinforce the attachment.

To release the footrest hanger 140 from the second joint member 150, a release lever 158, pivotally connected to the gusset 164 and attached to the latch member 152 by a fastener 159 extending through a slot 156 in the horizontal tubular section, is pivoted to retract the latch member 152 out of interlocking engagement with the insert 148. The spring loaded guide 166 then pushes the footrest hanger 140 upward, to allow rotation of the footrest hanger about the fitting 143 and to facilitate separation of the footrest hanger 140 from the second joint member 150.

The exemplary first and second joint members 130, 150, include overlapping semi-cylindrical end portions shaped to allow for pivoting movement of the second joint member with respect to the first joint member. Similar to the schematically illustrated assembly 10 of FIGS. 1A-1C, the first and second joint members 130, 150 each include pivot apertures 132, 152 that align to receive a pivot fastener 133 (e.g., a bolt or pin) about which the second joint member 150 is permitted to pivot to adjust an angular position of the second joint member with respect to the first joint member 130 to adjust the orientation of a footrest 170, mounted to the footrest hanger 140, with respect to the side frame member 120. In a first (neutral) angular position of the second joint member (FIG. 4), a first lock aperture 134 of the first joint member 130 aligns with a first lock aperture 154 of the second joint member 150 to receive a lock fastener 163, which secures the second joint member 150 in the first angular position. In a second (outward) angular position of the second joint member, a second lock aperture 135 of the first joint member 130 aligns with a second lock aperture 155 of the second joint member 150 to receive the lock fastener 163, which secures the second joint member 150 in the outward angular position. In a third (inward) angular position of the second joint member 150, a third lock aperture (not shown) of the first joint member 130 aligns with the second lock aperture 155 of the second joint member 150 to receive the lock fastener 163, which secures the second joint member 150 in the third angular position. While the joint members bay be configured to accommodate any suitable or desirable angular position of the of the footrest hanger, in an exemplary embodiment, the lock apertures of the first and second joint members are positioned to accommodate a straight/neutral angular position, an angled left position (e.g., about 10°-30° from neutral, or about 22.5° from neutral), and an angled right position (e.g., about 10°-30° from neutral, or about 22.5° from neutral).

While the pivot fastener 133 and lock fastener 163 may include any suitable fasteners, in an exemplary embodiment, either or both of the fasteners 133, 163 are threaded fasteners configured to be tightened with threaded portions of the corresponding pivot apertures 132, 152 and/or lock apertures 134, 154; 135, 155; 136, 155 to provide a sturdy, robust attachment between the side frame member 120 and the footrest hanger 140 and footrest plate 170, components that may be routinely subjected to substantial forces and impacts during use of the wheelchair.

To adjust the angular position of the second joint member 150 with respect to the first joint member 130, the lock fastener 163 is removed from the aligned lock apertures, the pivot fastener 163 is loosened, and the footrest hanger 140 and second joint member 150 are pivoted about the pivot fastener 133 to a desired angular position coinciding with alignment of lock apertures of the first and second joint members 130, 150. The lock fastener 163 is installed through the newly aligned lock apertures to secure the footrest hanger 140 and second joint member 150 in the selected angular position.

According to another aspect of the present application, a footrest plate may be adjustably secured to a footrest hanger, for example, to accommodate a variety of foot positions, including non-standard foot positions resulting from skeletal deformities of the legs, ankles, and feet. While the footrest plate may be hingedly attached to the footrest hanger for adjustment of a forward/rearward, proximal/distal, or swivel left/right angle of the footrest plate, in an exemplary embodiment, a footrest assembly is provided with a ball and socket joint arrangement configured to provide for secure positioning of the footrest plate in any combination of forward (toe down), rearward (toe up), lateral up, proximal up, and swivel positions, for example, to accommodate planar flexion, dorsal flexion, inversion, and eversion ankle and foot positioning requirements.

Figure 3:
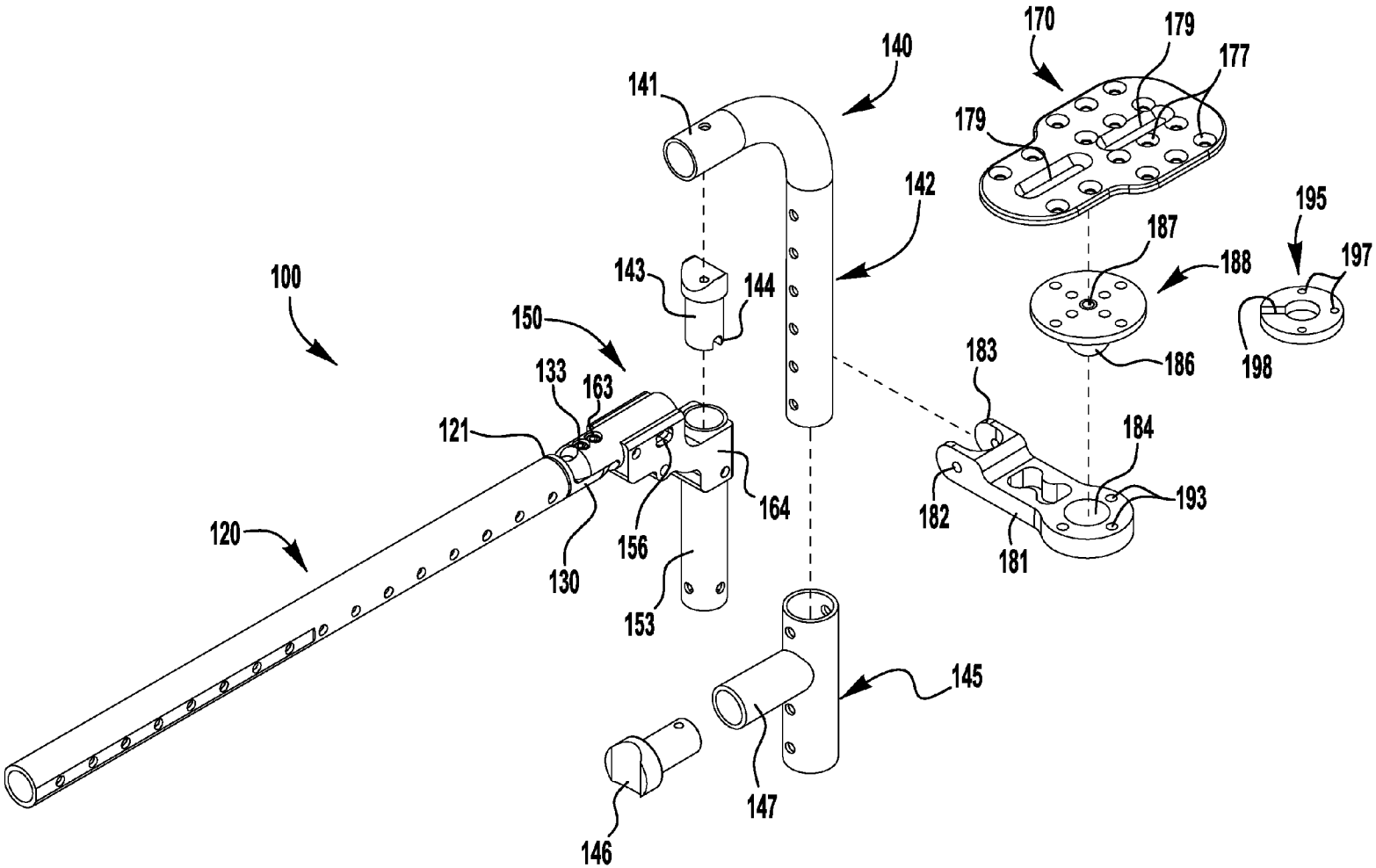
FIG. 3 illustrates a partial exploded upper perspective view of the adjustable footrest assembly of FIG. 2.
Figure 4A:
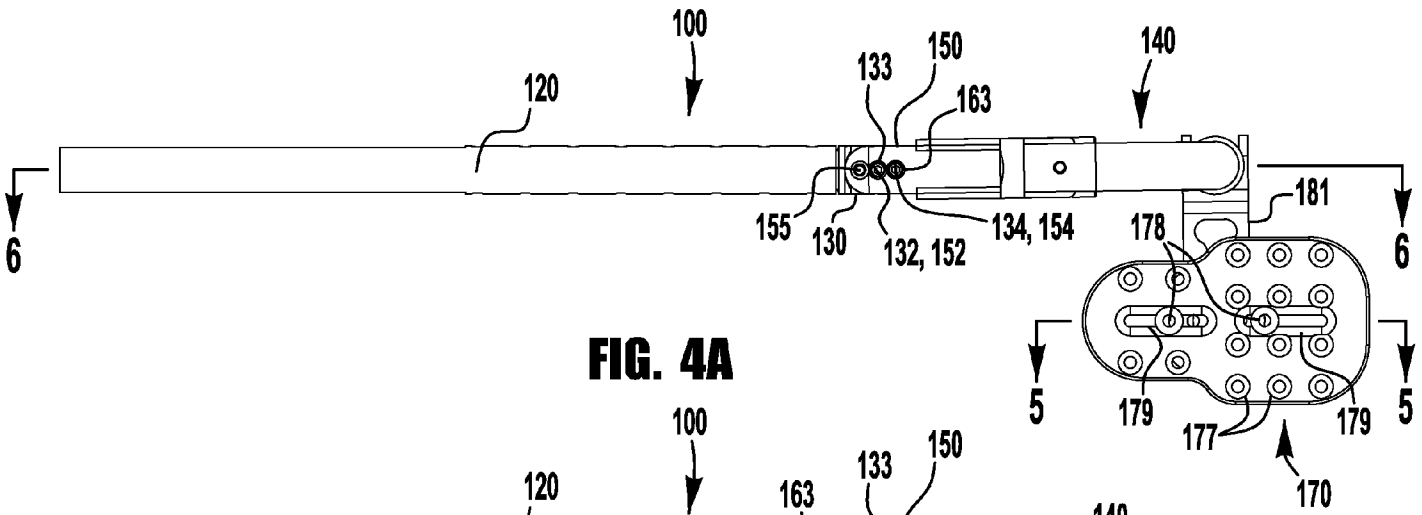
FIG. 4A illustrates a top view of the adjustable footrest assembly of FIG. 2, shown with the footrest hanger in a first angular position.
Figure 4B:
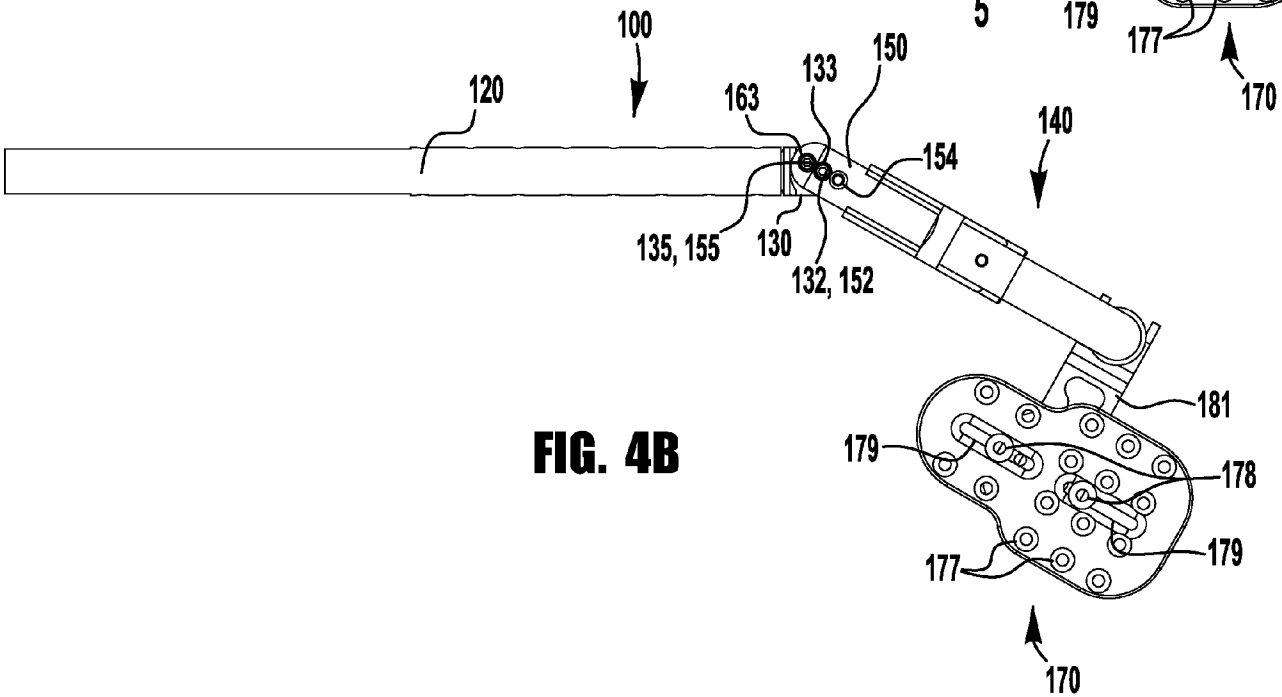
FIG. 4B illustrates a top view of the adjustable footrest assembly of FIG. 2, shown with the footrest hanger in a second angular position.
Figure 4C:
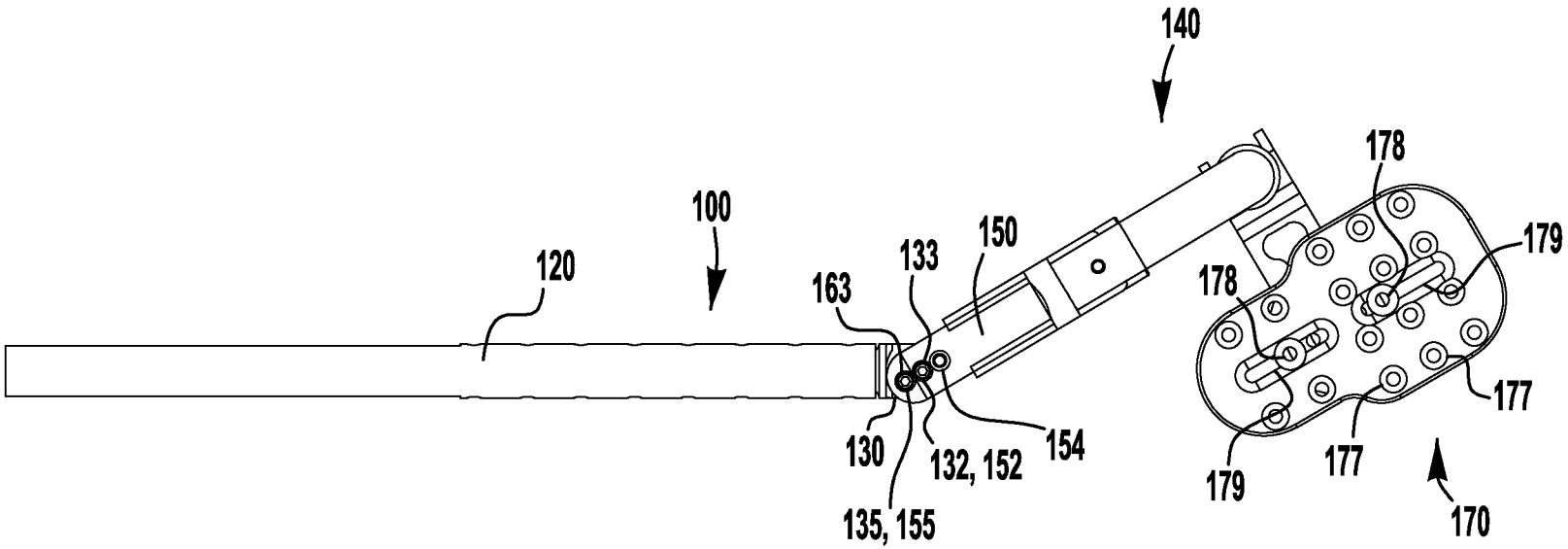
FIG. 4C illustrates a top view of the adjustable footrest assembly of FIG. 2, shown with the footrest hanger in a third angular position.

In the exemplary embodiment of FIGS. 2-6, a footrest plate mounting assembly 180 includes a footrest plate mounting bracket 181 secured to the footrest hanger 140 (for example, by a fastener installed through a mounting hole 182 in the bracket 181 aligned with selected holes 172 in the vertical portion 142 of the footrest hanger 140). As shown, the mounting bracket may include an enlarged U-shaped attachment portion 183 (FIG. 3), to provide rigid support between the footrest hanger 140 and the mounting bracket 181. In other embodiments (not shown), the mounting bracket attachment portion may be contoured or otherwise configured to allow the mounting bracket to be pivoted or folded upward, for example, to facilitate storage or transportation of the wheelchair. The mounting bracket 181 includes a concave spherical surface 184 sized and shaped to receive a ball portion 186 of a ball joint 185 (FIGS. 3 and 5). As shown in FIG. 5, a stem portion 187 of the ball joint 185 is secured to the footrest plate 170, such that the position of the footrest plate is adjustable by moving the ball joint 185 with respect to the mounting bracket 181. While the stem portion 187 of the ball joint 185 may be affixed directly to the footrest plate 170, in the illustrated embodiment, the stem portion 187 is affixed (e.g., welded) to an adapter plate 188, which may be secured to the footrest plate 170 in a variety of positions, thereby allowing the lateral and/or longitudinal position of the footrest plate, with respect to the footrest hanger 140, to be adjusted within a plane defined by the footrest plate. In the illustrated example, the footrest plate 170 includes mounting slots 179 that may be positioned with respect to corresponding mounting holes 189 in the adapter plate 188, with mounting bolts or other suitable fasteners 178 (FIGS. 4A-C) installed through the aligned slots 179 and holes 189 to secure the footrest plate 170 in the selected position. As shown, the mounting slots 179 may be provided with chamfered edges for seating engagement with a chamfered head on the bolts. As shown, the footrest plate 170 may include additional mounting holes 177 for further attachment (e.g., with additional bolts) when aligned with corresponding mounting holes in the adapter plate 188, and/or for attachment of other accessories, such as, for example, foot retaining straps or guards.

To secure the ball joint 185 in a selected position with respect to the footrest plate mounting bracket 181, as shown in FIG. 5, a collar 195 or other suitable clamping member is assembled with the mounting bracket over the ball portion 186 of the ball joint 185, thereby capturing the ball portion between the collar 195 and the mounting bracket. The collar 195 may, but need not, include a spherical concave surface 196 to closely receive the ball portion 186 of the ball joint. Fasteners 194 attaching the collar 195 to the mounting bracket 181 (through aligned mounting holes 193, 197) are tightened to apply a clamping or gripping force on the ball portion 186, thereby securing the ball joint 185 against additional movement. To adjust the position of the ball joint 185 with respect to the mounting bracket 181, the collar 195 is loosened (e.g., by loosening the fasteners) to reduce the gripping force on the ball portion 186. As shown in FIG. 3, the collar may include a slotted portion 198 allowing the collar to be installed (and removed from) around the stem portion of the ball joint.

To improve the clamping grip on the ball portion 186, at least an outer portion of the ball portion may be provided in a compressible material (e.g., a rubber coating), thereby providing for a more uniform grip between the ball portion and the concave spherical surfaces 184, 196 of the mounting bracket 181 and collar 196. In another embodiment, a footrest assembly may additionally or alternatively include mounting bracket and/or collar concave surfaces that include compressible materials.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, devices and components, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. An adjustable seating frame assembly for a wheelchair, the assembly comprising:

a side frame member;

a first joint member affixed to the side frame member, the first joint member including a first pivot aperture and at least one first lock aperture;

a footrest hanger;

a second joint member affixed to the footrest hanger, the second joint member including a second pivot aperture and at least one second lock aperture;

a pivot fastener secured through the first and second pivot apertures to pivotally attach the second joint member to the first joint member; and a lock fastener secured through a selected one of the at least one first lock aperture and a selected one of the at least one second lock aperture to secure the second joint member in a selected one of a plurality of angular position with respect to the first joint member;

wherein one of the at least one first lock apertures is positioned proximal to a terminal end of the first joint member, and another of the at least one first lock apertures is positioned distal to the terminal end of the first joint member and opposite the first pivot aperture.

2. The assembly of claim 1, wherein the footrest hanger is releasably attached to the second joint member.

3. The assembly of claim 1, wherein the footrest hanger includes a downward extending fitting and the second joint member includes a vertical tubular section that receives the downward extending fitting.

4. The assembly of claim 1, wherein one of the at least one second lock apertures is positioned proximal to a terminal end of the second joint member, and another of the at least one second lock apertures is positioned distal to the terminal end of the second joint member and opposite the second pivot aperture.

5. The assembly of claim 1, wherein the plurality of angular positions of the second joint member with respect to the first joint member includes a straight position, an angled left position, and an angled right position.

6. An adjustable footrest assembly for a wheelchair, the assembly comprising:

a footrest hanger having a vertically extending section;

a footrest plate having a substantially planar foot supporting surface;

a mounting bracket secured to the vertically extending section of the footrest hanger;

a ball joint including a ball portion received in a concave spherical recess in the mounting bracket and a stem portion secured to the footrest plate;

a clamping member disposed between the footrest plate and the mounting bracket, and assembled with the mounting bracket to clamp the ball portion of the ball joint between the clamping member and the mounting bracket.

7. The assembly of claim 6, wherein at least one of the ball portion and the concave spherical recess includes a compressible material.

8. The assembly of claim 6, wherein the ball portion of the ball joint includes a rubber coating.

9. The assembly of claim 6, wherein the clamping member includes a slotted portion sized to receive the stem portion therethrough for removably installing the clamping member between the footrest plate and the mounting bracket.

10. The assembly of claim 6, wherein the clamping member comprises a concave spherical recess for bearing engagement with the ball portion of the ball joint.

11. The assembly of claim 6, wherein the clamping member includes mounting apertures that align with corresponding mounting apertures in the mounting bracket to receive mounting fasteners for tightening the mounting bracket and clamping member against the ball portion.

12. The assembly of claim 6, further comprising an adapter plate affixed to the stem portion, the adapter plate being configured to be assembled with the footrest plate in a plurality of positions to allow for adjustable positioning of the footrest plate with respect to the ball joint stem portion.

13. The assembly of claim 12, wherein the adapter plate includes a plurality of mounting apertures positioned to align with one or more mounting apertures in the footrest plate to receive mounting fasteners for securing the footrest plate to the adapter plate.

14. An adjustable seating frame assembly for a wheelchair, the assembly comprising:

a side frame member;

a first joint member affixed to the side frame member, the first joint member including a first pivot aperture and at least one first lock aperture;

a footrest hanger;

a second joint member affixed to the footrest hanger, the second joint member including a second pivot aperture and at least one second lock aperture;

a pivot fastener secured through the first and second pivot apertures to pivotally attach the second joint member to the first joint member; and a lock fastener secured through a selected one of the at least one first lock aperture and a selected one of the at least one second lock aperture to secure the second joint member in a selected one of a plurality of angular position with respect to the first joint member;

wherein one of the at least one second lock apertures is positioned proximal to a terminal end of the second joint member, and another of the at least one second lock apertures is positioned distal to the terminal end of the second joint member and opposite the second pivot aperture.

15. The assembly of claim 14, wherein the footrest hanger is releasably attached to the second joint member.

16. The assembly of claim 14, wherein the footrest hanger includes a downward extending fitting and the second joint member includes a vertical tubular section that receives the downward extending fitting.

17. The assembly of claim 14, wherein the plurality of angular positions of the second joint member with respect to the first joint member includes a straight position, an angled left position, and an angled right position.

18. An adjustable seating frame assembly for a wheelchair, the assembly comprising:

a side frame member;

a first joint member affixed to the side frame member, the first joint member including a first pivot aperture and at least one first lock aperture;

a footrest hanger;

a second joint member affixed to the footrest hanger, the second joint member including a second pivot aperture and at least one second lock aperture;

a pivot fastener secured through the first and second pivot apertures to pivotally attach the second joint member to the first joint member; and a lock fastener secured through a selected one of the at least one first lock aperture and a selected one of the at least one second lock aperture to secure the second joint member in a selected one of a plurality of angular position with respect to the first joint member;

wherein the plurality of angular positions of the second joint member with respect to the first joint member includes a straight position, an angled left position, and an angled right position.

19. The assembly of claim 18, wherein the footrest hanger is releasably attached to the second joint member.

20. The assembly of claim 18, wherein the footrest hanger includes a downward extending fitting and the second joint member includes a vertical tubular section that receives the downward extending fitting.

21. The assembly of claim 18, wherein one of the at least one first lock apertures is positioned proximal to a terminal end of the first joint member, and another of the at least one first lock apertures is positioned distal to the terminal end of the first joint member and opposite the first pivot aperture, and wherein one of the at least one second lock apertures is positioned proximal to a terminal end of the second joint member, and another of the at least one second lock apertures is positioned distal to the terminal end of the second joint member and opposite the second pivot aperture.

* * * * *